United States Patent [19]

Crawford

[11] 4,073,223

[45] Feb. 14, 1978

[54] BAG SLOW DOWN

[75] Inventor: Donald C. Crawford, Green Bay, Wis.

[73] Assignee: FMC Corporation, San Jose, Calif.

[21] Appl. No.: 735,223

[22] Filed: Oct. 22, 1976

[51] Int. Cl.[2] ..... B31B 1/94

[52] U.S. Cl. ..... 93/93 HT; 83/94; 271/69; 271/182

[58] Field of Search ..... 271/69, 182, 80; 93/8 R, 93 R, 93 DP, 93 HT; 225/100; 83/94, 110

[56] References Cited

U.S. PATENT DOCUMENTS

| | | | |
|---|---|---|---|
| 1,752,648 | 4/1930 | Matthews | 271/182 |
| 2,717,642 | 9/1955 | Pealler | 225/100 |
| 3,981,496 | 9/1976 | Jensen et al. | 271/80 |

*Primary Examiner*—James F. Coan

*Attorney, Agent, or Firm*—L. J. Pizzanelli; C. E. Tripp

[57] ABSTRACT

This application discloses an improved device for reducing the velocity at which thermoplastic bags, as they are produced by a bag machine, are directed to a table, or other suitable support, for accumulation in even-edged stacks.

2 Claims, 4 Drawing Figures

W.S.
B

BAG SLOW DOWN

BACKGROUND OF THE INVENTION

With the advent of high speed thermoplastic bag making machines the need for a variety of controls became essential to produce high quality bags and bags of various varieties. Present day high speed bag machines can operate, for certain bag dimensions and bag styles, up to 300 bags a minute. At such speeds it is essential that the bags are accumulated in stacks containing a pre-determined number of bags and that the bags in each stack are accumulated so that the respective bag edges are in vertical alignment much like a deck of cards. To achieve alignment of the successive bags to produce neatly registered bag stacks it is essential that the velocity of the bag is reduced as it approaches the stack-forming gates or abutments which are located on a table adjacent to the discharge end of the bag machine.

To achieve this result the present invention includes a device operable in time relation with the cycle rate of the bag machine for retarding the velocity of the bags. The basic arrangement of the subject matter of the present invention is disclosed in U.S. Pat. No. 3,722,376 issued Mar. 27, 1973 and assigned to the assignee of the present invention. By reference to this patent it is intended that its disclosure is incorporated herein. As shown in the referenced patent, after the leading portion of the plastic web has been severed and sealed by a heated seal bar, a bag is produced and it is received by stacker belts that transport the bag to a table that accumulates the bags in stacks. As the bag is discharged by the stacker belts, it encounters corrugating rollers which essentially consist of a lower and upper shaft mounting discs which are staggered relative to each other so as to impart a slight wavy configuration to the bags. This provides the bags with a certain amount of stiffness in the direction of bag transport.

Adjacent the corrugating device bag machines incorporate transverse simultaneously driven vertically spaced shafts which include radial projections mounting longitudinally extending pads that momentarily make contact with the trailing edge of the bags in order to reduce its velocity. Such a reduction of velocity, considering the thin filmy character of some of the plastic bags, reliably prevents "floating" and of course insures that the bag travels in a downwardly sloping path to the location where a bag stack is being accumulated. While the bag retarding or slow down device of the prior art has served reasonably well for bag machine speeds of up to 200 cycles per minute, it has been found that above such rate a slow-down device with one projecting pad on each shaft cannot be operated in the proper synchronism to retard bags produced at machine speeds in excess of 200 cycles per minute.

SUMMARY OF THE INVENTION

According to the present invention, a slow-down device having more than one bag engaging pad on the slow-down shafts is disclosed. This arrangement has been found to effectively retard each bag.

DESCRIPTION OF THE PREFERRED EMBODIMENT

Figures 1, 2, 2A, 3:
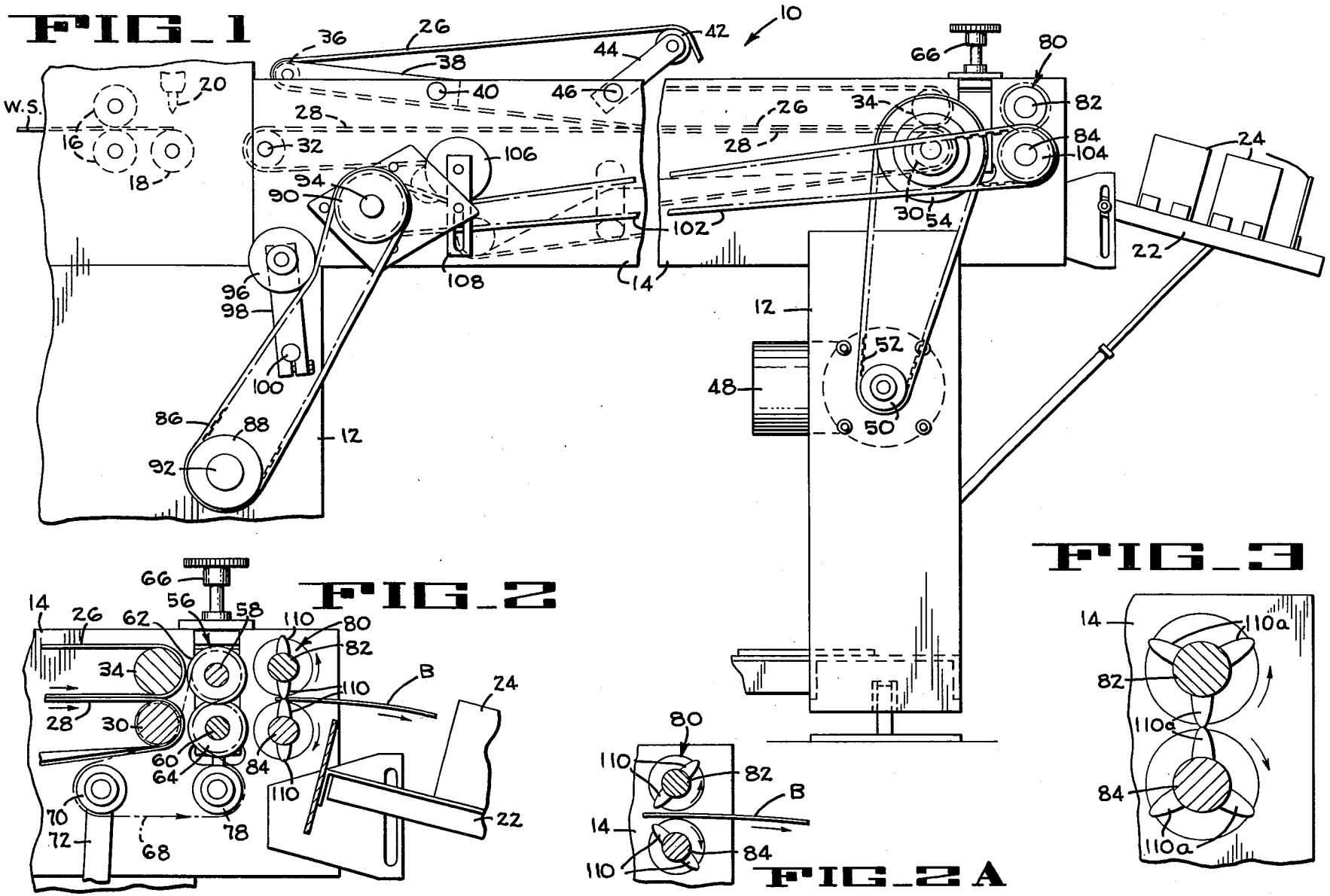
FIG. 1 is a side elevation of a portion of a bag machine incorporating the novel slow-down device of the present invention.
FIG. 2 is a slightly enlarged fragmentary longitudinal section illustrating a slow-down device having diametrically opposed bag engaging members on each of vertically spaced shafts.
FIG. 2A is a fragmentary section illustrating the slow-down device just prior to engagement with a bag.
FIG. 3 is a further enlarged fragmentary section of the slow-down device showing three bag engaging pads on each shaft.

FIG. 1 shows the stacker belts and the supporting frame and it is generally indicated by the numeral 10. The frame comprises laterally spaced upwardly extending legs 12 (only two of which are shown) having their upper ends attached to laterally spaced longitudinally extending side plates 14 (only one of which is shown). The web strip WS unwound from a supply roll of thermoplastic material is intermittently fed by a pair of driven draw rolls 16 to an adjacent seal roll 18 and a vertically aligned heated seal bar 20 which is reciprocated in a vertical plane in synchronism with the operation of the draw rolls 16. More specifically, when the draw rolls are rotated a portion of the web strip WS is fed between the seal roll and the seal bar 20. After the predetermined increment of web has been fed, the draw rolls are stopped and the seal bar descends forceably engaging the seal roll 18 in order to sever and seal the web strip and thus produce a bag. Almost simultaneously with raising of the seal bar 20, the seal roll 18 is rotated in the direction in which the web strip is fed, and the bag produced is conveyed by the stacker belts to a stack accumulating table 22 on the upper surface of which is positioned fences or gates 24 for accumulating the successive bags in a neatly registered pile.

The stacker belts mounted on the frame 10 include a set of upper belts 26 and a set of lower belts 28. The lower belts extend between a drive shaft 30 and an idler shaft 32 while the upper stacker belts 26 extend from a drive shaft 34 and an oscillating idler nose roll 36 rotatably mounted on a pair of oscillating links 38 mounted on a transverse shaft 40 that is rocked, slightly out of phase, but in synchronism with the operating of the seal bar 20. More particularly the shaft 40 is rocked to rotate the links 38 in a counter clockwise direction to lower the roller 36 downwardly and thus bring the upper belts 26 in contact with the lower belt 38 immediately after a portion of web has been severed and sealed. The bags so produced are transported toward the stacking table 22. One manner in which the shaft 40 may be oscillated is shown and described in the above referenced U.S. patent and since this constructional arrangement does not form part of the present invention, further description is unnecessary. Each of the above upper stacker belts 26 passes over a tensioning roller 42 mounted on a short arm 44 having one end fixed or keyed to a transverse shaft 14.

The stacker belts are driven by a DC motor 48 which is associated with a course and fine adjustment potentiometer for accurately regulating the speed of the stacker belts 26 and 28. The motor 48 has a timing belt pulley 50 keyed on its output shaft and drives, by timing belt 52 and pulley 54, the shaft 30 of the lower stacker belts 28. The torque input to the shaft 30 is transferred to the shaft 34 by spur gears (not shown) operating to drive the confronting reaches of the upper and lower stacker belts from left to right, as viewed in FIG. 1.

Referring now to FIG. 2, which shows the discharge end of the stacker belt frame in greater detail, it will be seen that a bag corrugating device 56 is located longitudinally adjacent to the driven shafts 30 and 34. The corrugating device includes a pair of transversely extending vertically spaced shafts 58 and 60, respectively, the upper and lower shaft, on which are fixed a series of axially spaced discs 62 and 64. The discs are positioned on each of the shafts 58 and 60 so that the shafts may be adjusted toward or away from each other without interference by manual adjustment mechanisms 66. In effect, the discs 62 interdigitate relative to the discs 64 in order to provide each bag with an undulating configuration serving to provide stiffness and thus render the bags less susceptible to bending or other disorientation as they progress toward the fences 24 on the stacking table 22. The corrugating shafts 58 and 60 have mounted thereon timing pulleys for a double faced timing belt 68 driven by a timing pulley fixed to the driven shaft 30. The timing belt 68 is tensioned by an idler pulley 70 rotatably mounted on a pivotally adjustable arm 72. As shown in FIG. 2, the timing belt 68, wrapped around the pulley on the shaft 58, defines about 270° arc of contact whereas about 180° arc of contact is defined on the timing pulley secured to the shaft 60 by virtue of a lower adjustably mounted idler pulley 78.

In accordance with the present invention the slow-down mechanism, generally identified by the numeral 80, comprises vertically spaced transversely extending upper and lower shafts 82 and 84, respectively. On one end of the shafts meshing spur gears are fixed and they are driven in a direction indicated by the arrows shown in FIG. 2. The input drive to the slow-down shafts comprises a timing belt 86 extending between a drive pulley 88 and a driven pulley 90 which are keyed, respectively, to shafts 92 and 94. The belt 86 is properly tensioned by a roller 96 rotatably mounted on a link 98 clamped to a shaft 100. The shaft 94 also has keyed thereon another pulley (not shown) driving a belt 102 which is wrapped around a pulley 104 keyed to the shaft 84. Proper tension of the belt 102 is maintained by an idler pulley 106 mounted on a vertically adjustable slotted bracket 108.

Fixed to each of the shafts 82 and 84 are diametrically opposed axially extending and radially projecting bars all of which are identified by the numeral 110. While not specifically shown, the bars may take various configurations which may be deemed suitable for a particular application. For example, the bars can consist of a generally U-shaped rail in which is inserted a rubber or felt strip. Since the shafts 82 and 84 are driven by a geared connection, the bars 110 will always maintain the relationship whereby they will confront each other as shown in FIG. 2. As a bag, identified as B, is moving in the direction indicated by the arrow adjacent thereto, it passes between the shafts 82 and 84. At that time the two of the bars 110 are approaching each other (FIG. 2A). Immediately thereafter momentary contact is made with the trailing edge of the bag to thereby effect a slight retardation thereof. To be effective as a retarding device, the peripheral velocity of the bars 110 is always slightly less than the speed of the bags issuing from the corrugating rolls.

Accordingly, at bag machine speed of 300 or more bags per minute, the diametrically opposed bars 110 will insure that each and every bag is properly retarded before it is received on the stacking table 22.

FIG. 3, which is an enlarged fragmentary view confining its illustration to the shafts 82 and 84, shows a modification where each shaft mounts three slow-down bars **110*a* whose construction and mode of operation are substantially identical to that shown in FIG. 2. With this arrangement, the speed of the shafts 82 and 84** can be reduced and yet insure retardation of bags where dictated by the speed of operation. For example, speeds in excess of 300 bags per minute may indicate the necessity of a greater number of slow-down bars.

Although the best mode contemplated for carrying out the present invention has been herein shown and described, it will be apparent that modification and variation may be made without departing from what is regarded to be the subject matter of the invention as defined in the appended claims.

What I claim is:

1. In a thermoplastic bag making machine including stacker belts comprising vertically opposed narrow belts for receiving and longitudinally transporting bags, as they are produced, to a stacking table, corrugating wheels and a bag retarding device located at the discharge of said stacker belts, an independent electrically operable variable speed drive driving the stacker belts and the corrugating wheels, said retarding device comprising two contra-rotating vertically spaced shafts mounting axially extending radially projecting pads cooperating to simultaneously momentarily engage opposite panels of each bag adjacent its trailing edge during one revolution of said shafts, the improvement in the combination of said stacker belts and said retarding device comprising adjusting the speed of said variable speed drive for driving said stacker belts at a speed that effects a selected longitudinal separation of the successive bags conveyed to the stacking table, each shaft of said retarding device mounting at least two equally circumferentially spaced pads, drive means derived directly from the drive of said bag machine, for rotating said vertically spaced contra-rotating shafts at a speed such that the peripheral speed of the radially projecting pads is less than the speed of the bags conveyed by said stacker belts, said contra-rotating shafts being synchronized so that the pads on one shaft making contact at a rate corresponding to the rate at which the bags are discharged toward the stacking table by said stacker belts, whereby the rotational rate of said contra-rotating shafts, by virtue of mounting two pads retards two successive bags during one revolution.

2. The retarding device of claim 1 wherein each shaft mounts three equally circumferentially spaced pads.

* * * * *

UNITED STATES PATENT OFFICE

CERTIFICATE OF CORRECTION

Patent No. 4,073,223 Dated February 14, 1978

Inventor(s) DONALD C. CRAWFORD

It is certified that error appears in the above-identified patent and that said Letters Patent are hereby corrected as shown below:

Col. 2, line 50, change "38" to --28--.

Signed and Sealed this

*Twentieth* Day of *November 1979*

[SEAL]

*Attest:*

RUTH C. MASON
*Attesting Officer*

LUTRELLE F. PARKER
*Acting Commissioner of Patents and Trademarks*